United States Patent [19]

Pickert et al.

[11] 3,974,785

[45] Aug. 17, 1976

[54] METHOD AND ARRANGEMENT FOR SEWING A SLIDE FASTENER INTO A CARRIER MATERIAL

[75] Inventors: Hansjürgen Pickert, Kerkrade, Niederlande; Dieter Sesselmann, Rodingen, both of Germany

[73] Assignee: William Prym-Werke KG, Stolberg, Rhineland, Germany

[22] Filed: Dec. 19, 1974

[21] Appl. No.: 534,506

[30] Foreign Application Priority Data

Dec. 22, 1973 Germany ..... 2364393

[52] U.S. Cl. ..... 112/113; 112/105; 112/152; 112/121.15

[51] Int. Cl.[2] ..... D05B 3/12

[58] Field of Search ..... 112/113, 104, 105, 114, 112/262, 121.15, 121.11, 121.12, 163, 151, 152

[56] References Cited

UNITED STATES PATENTS

| | | | |
|---|---|---|---|
| 2,268,799 | 1/1942 | Butow | 112/105 |
| 3,608,506 | 9/1971 | Glindmeyer | 112/105 |
| 3,762,347 | 10/1973 | Sesselmann et al. | 112/105 |
| 3,799,086 | 3/1974 | Block | 112/121.15 |

*Primary Examiner*—H. Hampton Hunter
*Attorney, Agent, or Firm*—Michael J. Striker

[57] ABSTRACT

A multiple-needle sewing machine has a presser foot and first and second feed dogs for an upper and a lower layer of the carrier material into a slit of which this slide fastener is to be sewn. An arm is mounted on the sewing machine and can pivot in a horizontal plane between a position in which the material and the slide fastener are placed onto the arm and maintained in a predetermined relationship relative to one another, and a second position in which the material and the slide fastener are supplied, while still being maintained in this predetermined relative position, to the feed dogs which engage the material and advance it as the sewing machine sews the slide fastener to the material.

9 Claims, 5 Drawing Figures

METHOD AND ARRANGEMENT FOR SEWING A SLIDE FASTENER INTO A CARRIER MATERIAL

BACKGROUND OF THE INVENTION

The present invention relates to the sewing of a slide fastener into a slit formed in a carrier material that is composed of an upper and at least one lower layer.

More particularly, the invention relates to a method of so sewing the slide fastener to the carrier material, and to an arrangement for carrying out the method.

In some instances, a slide fastener is to be sewn only to a single layer carrier material. There are, however, many instances in which a slide fastener must be sewn to a carrier material which is formed with a slit into which the slide fastener is to be secured, and which carrier material is composed of an upper and at least one lower layer. For example, the perhaps most frequent application of this type is when a slide fastener must be sewn to a garment, such as a skirt or the like, that is composed of the outer layer of material and an inner layer of lining material.

For this purpose, the prior art provides arrangements which use twin-needle or multiple-needle sewing machines and in which the entire operation of supplying the material and the slide fastener, orienting them relative to one another and sewing the slide fastener to the material, is carried fully automatically without requiring any manual guidance by an operator. However, while this part of the operation is automated, the prior arrangement of the material and the slide fastener with reference to one another, before the equipment takes over for the automatic supplying to the sewing machine, and the sewing of the slide fastener to the carrier material, must be carried out manually. The guiding devices for the material and the slide fastener which are required in this prior-art arrangement are so complicated that the insertion of the material in the slide fastener into these guiding devices requires an inordinate amount of manual labor which has no reasonable relationship to the amount of time that is saved by automating the subsequent operations. Thus, all or substantially the time that is saved by the subsequent automatic operations is lost by the preliminary manual handling that is required.

Other prior-art proposals suffer from analogous disadvantages, including the fact that some of them make it almost impossible for the operator to have access to the needle area of the sewing machine and that in some instances only an endless slide fastener can be employed, rather than a slide fastener of predetermined length, in which case a part of the slide fastener that is being withdrawn from an endless supply is sewn in place and is then cut off from the supply.

SUMMARY OF THE INVENTION

Accordingly, it is a general object of the invention to overcome the disadvantages of the prior art.

More particularly, it is an object of this invention to provide an improved method of sewing a slide fastener of predetermined length into a slit formed in a carrier material that is composed of an upper and at least one lower layer.

An additional object of the invention is to provide an arrangement for carrying out the method.

A further object of the invention is to provide a method and an arrangement which permit an operator to manually preposition the material and the slide fastener in predetermined relationship to one another, at a location remote from the area where the sewing by the needles of the sewing machine occurs, so that the operator is not hindered by any components of the machine.

A further object of the invention is to provide such a method and arrangement which permit the relatively pre-positioned material and slide fastener to be supplied to the operative components of the sewing machine in their pre-positioned relationship, so that the sewing of the slide fastener to the material can then be effected.

In keeping with these objects, and with others which will become apparent hereafter, one feature of the invention resides in an arrangement for sewing a slide fastener into a slit formed in a carrier material that is composed of an upper and at least one lower layer. Briefly stated, this arrangement comprises a multiple-needle sewing machine having a presser foot and first and second feed dogs for said upper and said lower layer, respectively. Means are provided for engaging the carrier material and the slide fastener in predetermined relationship to one another, and for furnishing them to said feed dogs while maintaining said predetermined relationship.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
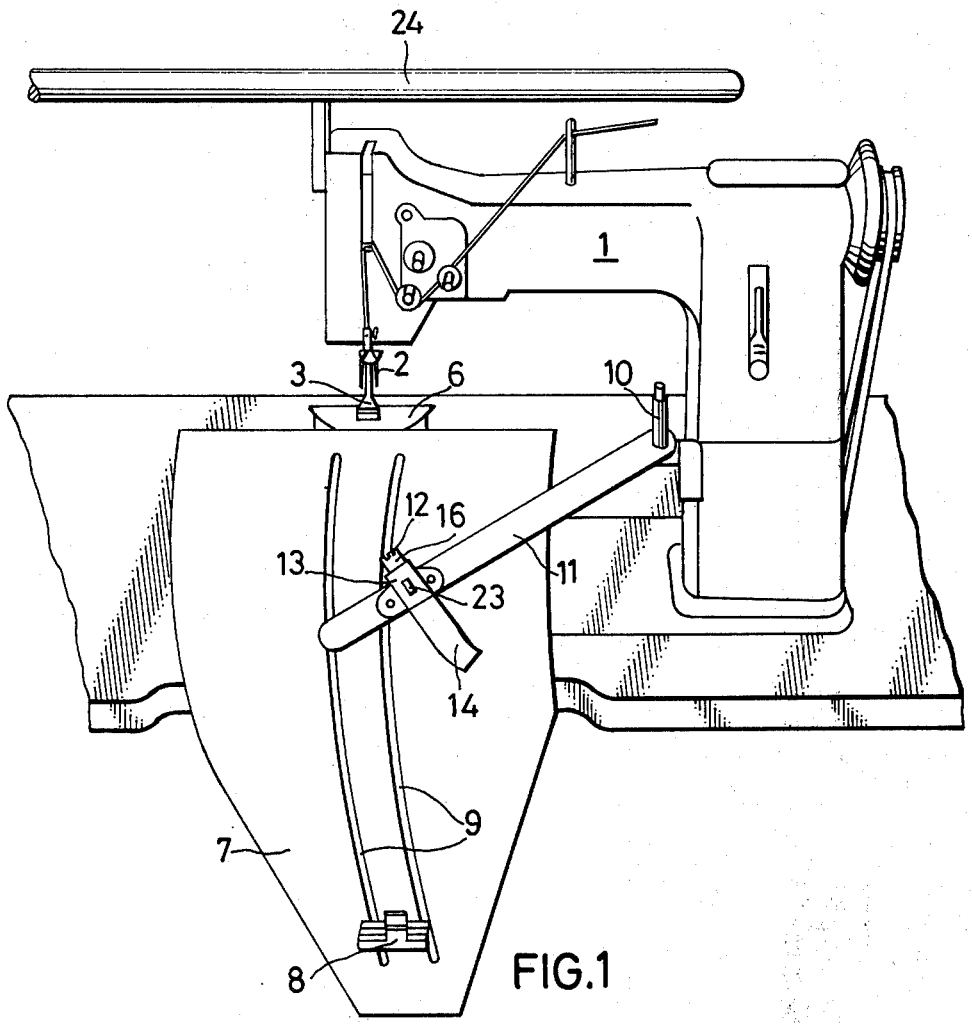
FIG. 1 is a diagrammatic perspective view illustrating an arrangement according to the present invention in one operative position.

The invention will be discussed with joint reference both to the novel method and the novel arrangement. FIGS. 1-5 show one exemplary embodiment of the novel arrangement, and FIGS. 1 and 3 illustrate particularly clearly that a twin-needle sewing machine 1 is employed in this embodiment in which the gripper cooperating with the two needles 2 are mounted in a column in the material-supporting face 6 of which the needle blade is mounted. The sewing machine 1 has a presser foot 3 and an upper feed dog 5 which is formed with needle openings 28 and which has a toothed working face that extends through a cutout formed in the presser foot 3 to cooperate with a corresponding lower feed dog 4. The upper feed dog 5 serves to advance the upper layer of the carrier material, for example the outer material of a garment, and the lower feed dog 4 serves to advance the lower layer of the same material, for example the lining layer of a garment.

Centrally located at the front side of the presser foot 3 is a vertically oriented abutment 15 which serves to guide the two lateral edges of the upper layer of the material during the sewing operation. The use of an upper and a lower feed dog is important for the invention because in this manner it is impossible for the sewing machine 1 to accept the prepositioned material and slide fastener from the arm 11, which will be discussed later, without requiring a preliminary setting of the needles 2 to their lowermost positions before the sewing operation can begin.

The lower layer of the material is supported and guided by a downwardly inclined supporting member 7 which is located laterally adjacent of the machine 1 and may constitute a part of the same. The downward inclination of the member 7 assures that it does not hinder the operator. The support member 7 is provided with a pair of guide grooves 9 and a tensioning carriage 8 can slide in these guide grooves 9 and is formed with a pivotally mounted portion 25 (see FIG. 4) which is hooked into the closed end of the slit formed in the carrier material, so that the carriage 8 tends to pull the material downwardly (e.g., in FIG. 1) and therefore maintains the material under slight tension due to the weight of the carriage 8. Shortly before the sewing operation is completed, during which operation the carriage 8 moves upwardly with the material, preferably as the carriage 8 moves in the horizontal portion of the member 7, the portion 25 enters into the groove 17 formed in the surface of the member 7 and thus moves out of the slit formed in the material, releasing the latter.

Figure 2:
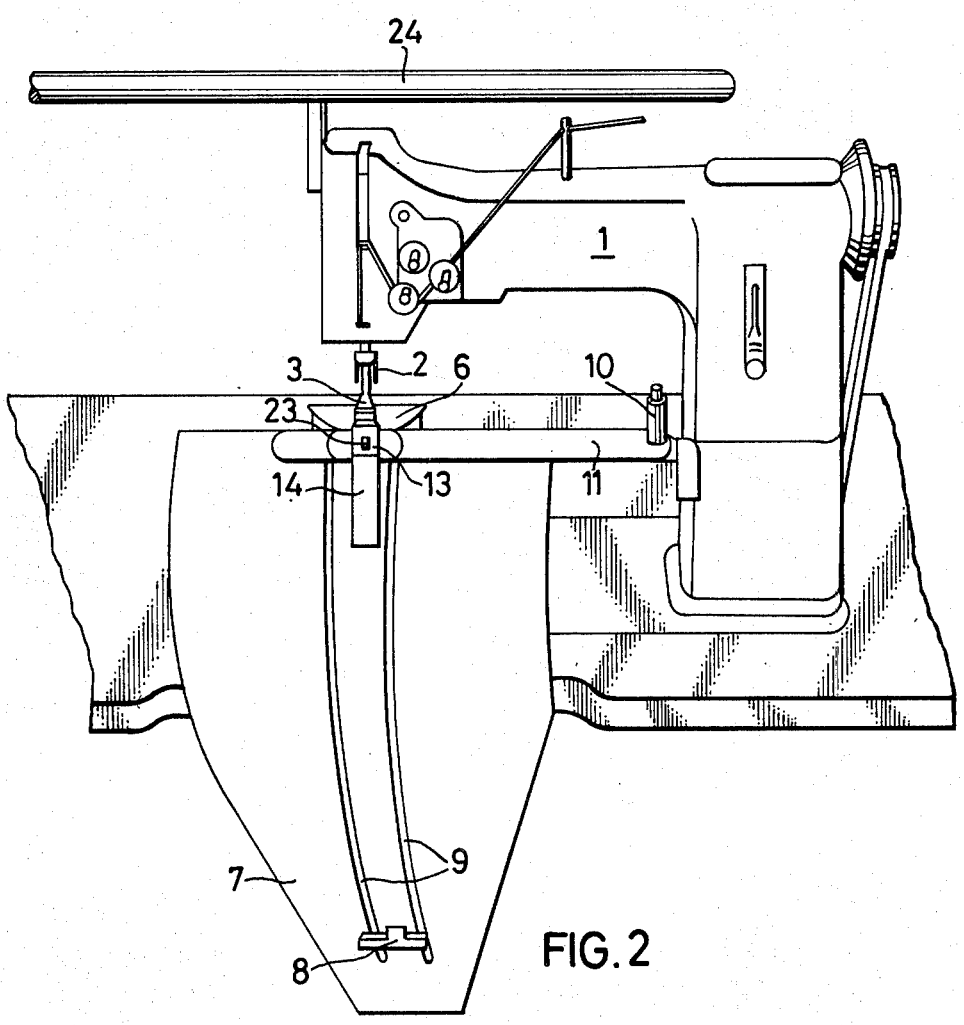
FIG. 2 is a view analogous to FIG. 1, but showing the arrangement in a second operative position.
Figure 3:
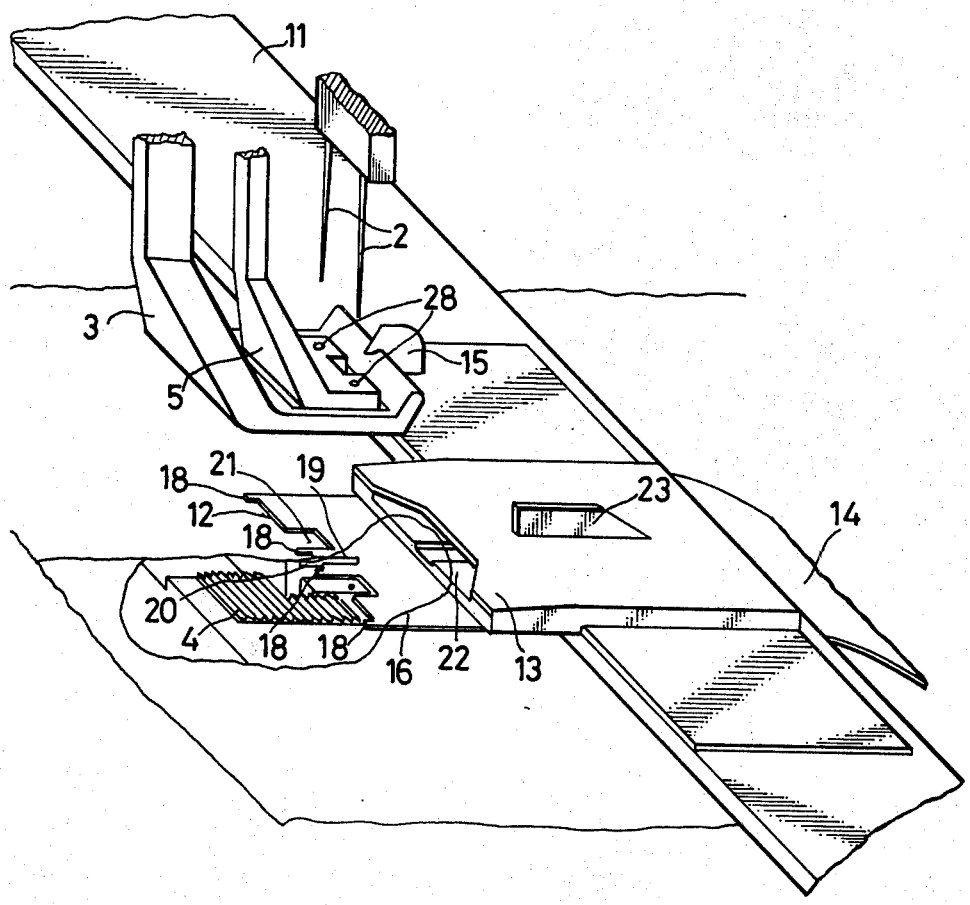
FIG. 3 is a fragmentary perspective view including a portion of the carrier material which is in part broken away, showing on an enlarged scale details of the arrangement when it is in the position of FIG. 2.

According to the invention, the sewing machine 1 is provided with an arm 11 that is mounted on the sewing machine by means of a vertical pivot 10, so that the arm 11 can pivot relative to the sewing machine 1 between the position shown in FIG. 1 and the position shown in FIG. 2. The arm carries a flat cross section sleeve 13 which extends substantially normal to the elongation of the arm 11 and which serves to guide a slide fastener that is supplied to the sleeve 13 by a support 14. The arm 11 is further provided with a separate plate or portion 16 located downwardly of the sleeve 13 and having a forward edge; a region 12 of this forward edge has a plurality of projecting pins 18 which serve to retain the material in a manner to be discussed. At the middle of the plate 16 there is formed a ridge-like raised portion 19 which serves as a guide for the chain of slide fastener elements of the slide fastener and which extends beyond the portion 12 to form a tongue 20. At opposite sides of the tongue 20 the plate portion 16 is formed with cutouts 21 through which the feed dogs 4 and 5 can extend into engagement with the material when the arm 11 is in the position of FIG. 2. The sleeve 13 has an outlet opening 22 from which the slide fastener issues as it is being sewn onto the material; this opening 22 is located immediately adjacent the plate portion 16 and the region 12. A resilient means, for example a spring or the like, is provided on the sleeve 13 or the support 14 to maintain the slide fastener in proper position.

Figure 4:
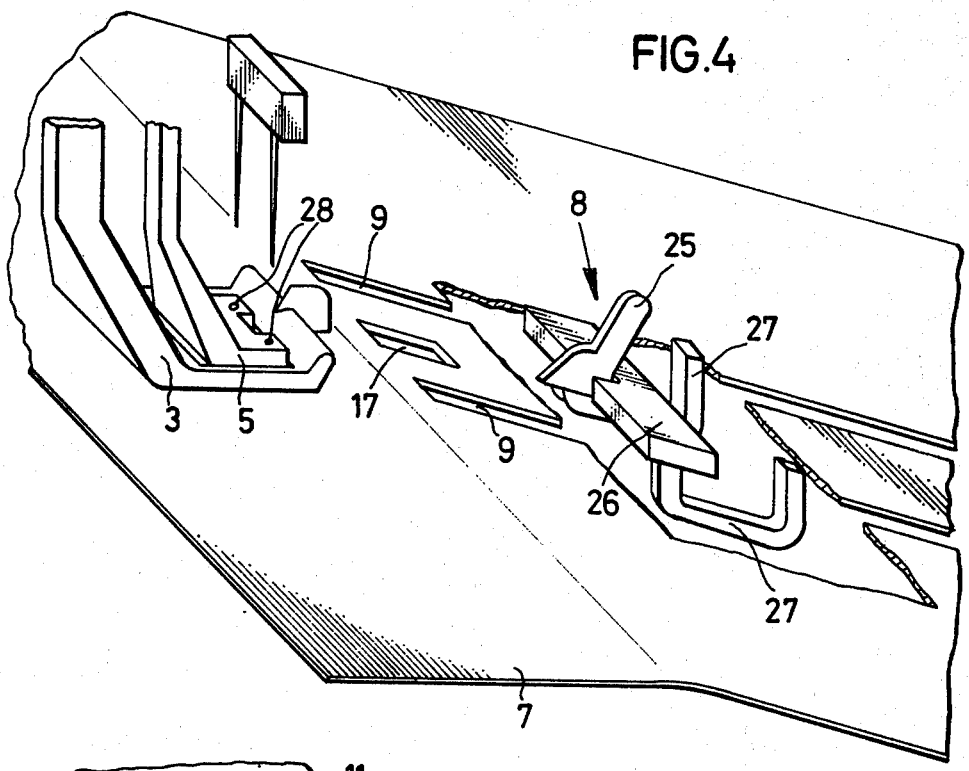
FIG. 4 is a fragmentary detail view on an enlarged scale showing further details of the novel arrangement.

FIG. 4 shows details of the construction of the element 8 which is composed of a transverse portion 26 that rests on the surface of the member 7 and extends across the cutouts 9. The underside of the portion 26 is provided with two U-shaped guide portions 27, the free ends of which extend from below into the cutouts 9. The projection 25 is pivotally mounted on the transverse portion 26 and is maintained in known manner in the erected position shown in FIG. 4, being the least when the member 8 reaches the uppermost position in which the projection 25 can pivot into the cutout 17 of the support 7, to disengage the lower layer of the material for free advancement by the feed dogs.

The operation of the arrangement, and simultaneously the details of the method, will now be described with respect to FIG. 5.

Figure 5:
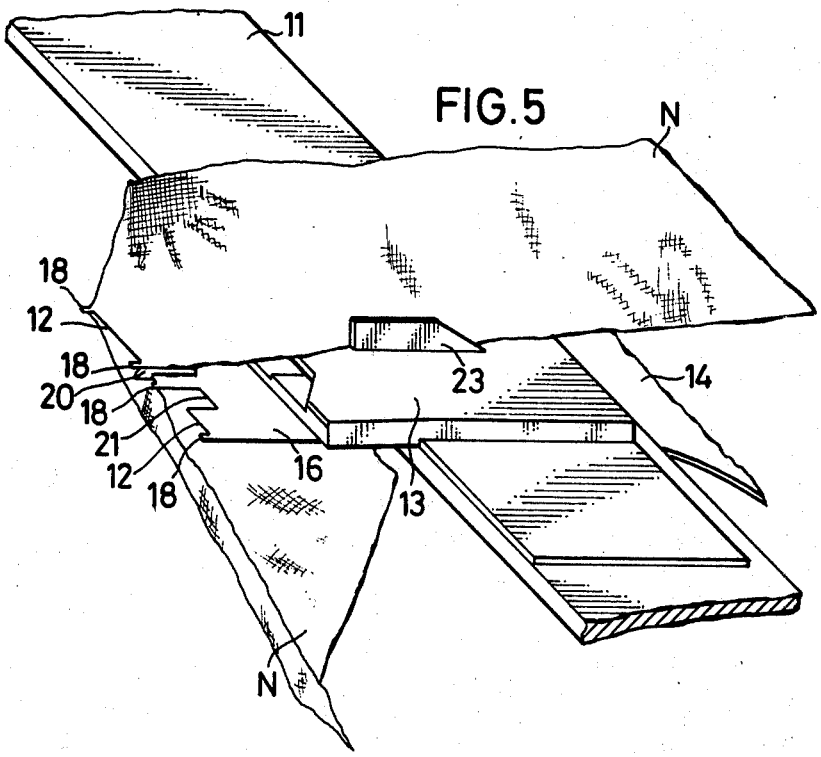
FIG. 5 is a fragmentary detail view showing how the material is positioned in the arrangement when the latter is in the operative position of FIG. 1.

The operator who will be seated in the normal position adjacent the sewing machine as in the case of any other sewing machine, will pivot the arm 11 to the position of FIG. 1 and thereupon will first place the right-hand side of the material (the terms right-hand and left-hand as used herein refer to the opposite sides of the material relative to the slit into which the slide fastener is to be sewn) composed of the upper and lower layers, onto the pins 12 so that the material (identified with reference character N in FIG. 5) is retained by the pins in a position in which it extends partly over the arm 11 and partly hangs downwardly from the arm 11, as shown in FIG. 5. The material N is retained by the pins 18 in a predetermined position with reference to the arm 11. The right-hand portion of the material N is aligned by the presence of the edge 23. When this is done, the left-hand side of the material N is similarly placed. The upper and lower layers may already be connected to an appropriate seam or the like as is known in the art.

After the material N is properly placed onto the arm 11, the leading end of the slide fastener is inserted into the guide sleeve 13 from the support 14 until it abuts against the fold formed in the material N by the engagement of the latter with the needles 18. The free end of the slide fastener is then placed upon the support 14. The material N and the slide fastener are now in a predetermined relative relationship.

The operator now proceeds to pivot the arm 11 with the retained material N and the slide fastener to the position shown in FIG. 2, placing the closed end of the slot that is formed in the material N over the projection 25 of the member 8 which is allowed to exert downward pull (lengthwise of the cutouts 9) upon the lower layer of the material N. The presser foot 3 is then lowered onto the material N and sewing can begin; during the sewing the operator guides the upper layer of the material by hand. Upon the lowering of the presser foot 3 and the starting of the sewing machine 1, the feed dogs 4 and 5 engage the material N to the left and to the right of the needles 2 and advance the material in the sewing direction. Towards the end of the slide fastener sewing operation, the projection 25 pivots into the cutout 17 and releases the lower layer of the material N, so that the sewing can be continued until the slide fastener is completely sewed into the slit. Subsequently, the slider is installed on the slide fastener in the usual way, and an end closure for the slide fastener is provided.

According to the invention, it is also possible to first place the material N onto the arm 11, move the arm with the material from the position of FIG. 1 to the position of FIG. 2, and only then to place the slide fastener into the guide sleeve 13. If this approach is chosen, the operator will briefly fold back the upper layer of the material N to obtain ready access to the sleeve 13 and to be able to insert the slide fastener into the latter. It is advisable in this case to provide a material-supporting bar 24 on the machine 1 over which the upper layer of the material N can be folded until the slide fastener has been inserted into the sleeve 13. Of course, such a bar 24 can be provided in any case if desired.

It is also possible according to the invention to provide means for arresting the arm 11 in the sewing position, that is in the position of FIG. 2, and to provide means for adjusting the orientation of the arm 11 when it is in the position of FIG. 2. Means may also be provided for guiding the edges of the upper layer which bound the slit formed therein, and these means may be provided on the presser foot of the sewing machine 1, and/or the arm 11. The resilient means for preventing undesired shifting or moving of the slide fastener out of its proper orientation may be in form of a leaf spring or the like.

It will be understood that each of the elements described above, or two or more together, may also find a useful application in other types of constructions differing from the type described above.

While the invention has been illustrated and described as embodied in an arrangement for sewing a slide fastener into a slit formed in a carrier material, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for sewing a slide fastener onto opposite sides of a slit in a carrier material that is composed of an upper and a lower layer, comprising a multiple needle sewing machine having a presser foot and first and second feed dogs for said upper and said lower layer, respectively, in the region of said presser foot; and means for engaging said carrier material and said slide fastener in a predetermined relationship to one another, said means comprising an arm and a pivot mounting said arm on said sewing machine for pivotal movement between a first position located laterally outside the region of said presser foot for conveniently placing said carrier material and said slide fastener thereon, and a second position in which it supplies said carrier material and said slide fastener to said region to be transported in said predetermined relationship by said feed dogs during the sewing operation.

2. An arrangement as defined in claim 1, wherein said arm comprises a portion provided with material-engaging pins, and a guide sleeve for said slide fastener located proximal to said portion.

3. An arrangement as defined in claim 2, and wherein said portion and said sleeve are so oriented relative to said arm that said pins are located adjacent said feed dogs and extend lengthwise of the sewing direction when said arm is in said second position.

4. An arrangement as defined in claim 3, wherein said portion is a discrete portion mounted on said arm and formed with openings through which said feed dogs can extend into contact with said material when said arm is in said second position.

5. An arrangement as defined in claim 4, said portion having a forward edge, and an upper side formed with a guide shoulder for the slide fastener members, said portion including a tongue-shaped projection extending forwardly of said edge, and said guide shoulder being at least in part formed on said projection.

6. An arrangement as defined in claim 1; and further comprising guide means on said pressure foot for guiding said upper layer during feeding of the same by said upper feed dogs.

7. An arrangement as defined in claim 1; and further comprising guide means on said arm for guiding said upper layer during feeding of the same by said upper feed dogs.

8. A method of sewing a slide fastener into a slit formed in a carrier material composed of at least an upper and a lower layer, comprising the steps of arranging the material and the slide fastener in predetermined relative orientation on a pivotable support positioned laterally outside the region of the presser foot of a sewing machine; pivoting said support so as to move said material to a position adjacent the presser foot in which said layers are engageable by the upper and lower feed dogs of the sewing machine, while maintaining said relative orientation; and sewing said slide fastener to said material.

9. An arrangement as defined in claim 1, wherein said presser foot is movable in a predetermined direction, and wherein said pivot has an axis extending in said predetermined direction.

* * * * *